US005455418A

United States Patent [19]

Hogan

[11] Patent Number: 5,455,418

[45] Date of Patent: Oct. 3, 1995

[54] MICRO-FOURIER TRANSFORM ION CYCLOTRON RESONANCE MASS SPECTROMETER

[76] Inventor: Jeremiah D. Hogan, 6207 Marquita Ave., Dallas, Tex. 75214

[21] Appl. No.: 349,864

[22] Filed: Dec. 6, 1994

[51] Int. Cl.[6] ..... H01J 49/38

[52] U.S. Cl. ..... 250/291; 250/281

[58] Field of Search ..... 250/291, 290, 250/281

[56] References Cited

U.S. PATENT DOCUMENTS 5,019,706 5/1991 Allemann et al. ..... 250/291

*Primary Examiner*—Jack I. Berman
*Attorney, Agent, or Firm*—W. James Brady, III, Richard L. Donaldson

[57] ABSTRACT

A mass spectrometer having a tube permeable to a magnetic flux, preferably glass, and having an exterior surface and an interior surface, the tube having a pair of opposing excite electrodes and a pair of opposing detect electrodes disposed at the interior surface, a pair of spaced apart magnets disposed on the exterior surface of the tube, the excite electrodes and the detect electrodes being disposed at least in part between the pair of magnets, an evacuatable chamber containing the tube and magnets and a pump to evacuate the evacuatable chamber. The excite electrodes are disposed in a first pair of opposing quadrants and the detect electrodes are disposed in a second pair of opposing quadrants, the excite electrodes being parallel to each other and the detect electrodes being substantially parallel to each other and substantially normal to the excite electrodes. The magnets are rare earth magnets, preferably cobalt rare earth magnets or sumarium cobalt rare earth magnets. The mass spectrometer further including plural conductors, one conductor for each excite electrode, each trap electrode and each detect electrode, each conductor extending through the tube to a different one of the excite electrodes and detect electrodes, for applying a sweep signal to the excite electrodes and detecting one of a voltage or current across the detect electrodes.

24 Claims, 1 Drawing Sheet

MICRO-FOURIER TRANSFORM ION CYCLOTRON RESONANCE MASS SPECTROMETER

BACKGROUND OF THE INVENTION

1. Field of the Invention

This invention relates to improvements in Fourier transform ion cyclotron resonance mass spectrometers.

2. Brief Description of the Prior Art

Mass spectrometry is an analytical technique for identification of chemical structures, determination of mixtures and quantitative elemental analysis based upon application of the mass spectrometer. Fourier transform ion cyclotron mass spectrometers generally include an evacuated chamber into which is leaked a gaseous form of a neutral species to be analyzed while the pressure in the chamber is maintained at about $1\times10^{-5}$ mm Hg. A gated electron beam is sent the length of the vacuum chamber through the center of the chamber. Electrons collide with the molecules of gas present and remove an electron from the molecules, thus creating a collection of low energy (thermal) positive ions which precess in a circle since they are disposed in a magnetic field directed along the chamber axis.

The ions are excited by applying a radio frequency (RF) "sweep" pulse which sweeps from a frequency below the lowest resonance frequency of the species involved to a frequency above the highest resonance frequency of the species involved, generally from about 200 KHz to about 2 MHz, to a pair of parallel excite electrodes in the chamber to provide an electric field resulting from the application of a potential difference of from a fraction of a volt to a few volts, depending upon the cell geometry, ion population and other factors, across the excite electrodes. As the pulse sweeps through the frequency range which represents the fundamental cyclotron frequencies of all ions of interest, this energy is absorbed by the ions when their fundamental oscillating frequency has been reached. This causes the ions to "spin up" to larger orbitals in order that the ions move closer to a pair of detect electrodes within the chamber which are generally parallel to each other and generally normal to the excite electrodes. As the ions are spinning up into these higher orbits, they fall into coherent packets, that is, they tend to draw together as they absorb the excite energy, thereby creating an iso-mass bundle of identical ions. This packet then resembles a relatively large, highly charged particle which orbits the chamber at the fundamental cyclotron frequency of the ions which make up this packet.

Ion packets are detected by monitoring the current induced by the ion packets onto the passive detect electrodes, this appearing as a sine wave. The frequency of the sine wave is then determined and, from known laws of physics, provides the mass of the ion under test. When plural ions are present, there is a superposition of several sine waves, requiring that a Fourier transform be performed thereon to obtain an indication of each of the distinct frequencies present. The above described procedure can be repeated many times per second to permit signal averaging and averaging out of noise, thereby providing improved signal/noise ratios.

Fourier transform ion cyclotron resonance mass spectrometers (FTICR/MS) have been known for some time. FTICR/MSs provide the same information as standard mass spectrometers. However, they are very precise in that they provide data which are orders of magnitude more precise than ordinary mass spectrometers and orders of magnitude more sensitive (possibly detecting as little as one ion) than ordinary mass spectrometers. Since the identification of the species under test is determined from the mass or atomic weight of the species under test, it is imperative that the instrumentation provide accuracy to a sufficient number of decimal places to differentiate between two species having very close atomic weights. For example, nitrogen and carbon monoxide both have an atomic weight of 28 and cannot be differentiated from each other when results can only be accurately provided to one decimal place. This is also true for nitrogen and carbon monoxide until accuracy to three decimal places can be obtained. Only at this point is there a difference in the atomic weights of these species wherein the atomic weights of the species are unique.

The use of such instruments has been limited in the past due to their enormous cost and large size. The prior art FTICR/MSs have required a superconducting magnet which requires liquid nitrogen and liquid helium for operation. The physical dimensions of the prior art FTICR/MSs have approached the dimensions of a small room whereas the strength of the magnet required in such instruments is such that it requires a roped off or off limits area therearound which is equal to about four times the area required for the FTICR/MS itself. It follows that FTICR/MSs of the prior art are not portable and therefore also find restricted use for that reason as well. It is therefore apparent that a FTICR/MS which can perform the function of prior art FTICR/MSs, yet be capable of fabrication at reduced cost and/or occupy a reduced amount of space and/or be portable would be a highly desirable instrument.

SUMMARY OF THE INVENTION

In accordance with the present invention, there is provided a FTICR/MS which displays all of the desired advantages enumerated above. A FTICR/MS in accordance with the present invention can be fabricated which has the approximate dimensions of less than one cubic foot, yet can provide similar accuracy, precision and sensitivity (to possibly as low as a single ion) as the prior art FTICR/MSs. Also, due to the reduction in size of several orders of magnitude, the cost of fabrication can also be substantially reduced by about two or more orders of magnitude. This will permit the FTICR/MS in accordance with this disclosure to be capable of dedicated use to provide a single measurement in a plant, for example, whereby the parameter being measured can be sent to a computer and provide on-line information which was not previously available in a practical sense.

Briefly, the above is accomplished by providing a non-metallic tube, preferably glass or quartz, having a pair of excite electrodes, a pair of trapping electrodes and a pair of detect electrodes each pair of electrodes on one of the interior or exterior surfaces of the tube, all of the electrodes being preferably on the interior surface of the tube. The excite electrodes are preferably disposed in a first pair of opposing quadrants and the detect electrodes are preferably in the other pair of opposing quadrants. Each electrode of each pair of electrodes is preferably parallel to the opposing electrode of the pair and each of the pairs of electrodes is preferably normal to the other pair of electrodes. Access to each of the electrodes is provided by a conductor passing through the tube to the electrode. The excite, detect and trap electrodes can be formed, for example, by coating the interior of the tube with a highly electrically conductive material, such as gold, and then scraping away the conductive material, leaving only that conductive material which forms the excite electrodes, the trap electrodes and the detect electrodes on the tube interior.

Permanent magnets, preferably but not limited to rare earth permanent magnets, are disposed around the tube with the tube disposed within a bore in the magnets, there preferably being at least two magnets spaced from each other on the tube. The conductors to the electrodes are disposed in the space between the magnets. The number of magnets is arbitary, it merely being necessary that the magnetic field provided be sufficiently strong to cause orbiting of the species under test. For higher atomic weights of the species under test, the magnetic field must be progressively stronger. When the magnets are separated with half of the magnets on each side of the space, the magnetic field appears to be better directed along the axis of the tube. Any permanent magnet which can provide a sufficiently strong magnetic field can be used. Preferred magnets are cobalt rare earth magnets of about 0.8 Tesla (8000 Gauss) and sumarium cobalt alloy rare earth magnets of about 0.92 Tesla (9200 Gauss).

The tube with magnets thereon is disposed in an evacuated chamber of predetermined vacuum, usually less than about $5\times10^{-5}$ mm Hg. The chamber is quenched by dropping the potential of one of a pair of trap electrodes to −5 volts while raising the other trap electrode to +5 volts. The trap electrodes are then returned to their normal setting of about +2 volts. The neutral species under test enters the chamber at a predetermined rate with the vacuum being maintained at, for example, $5\times10^{-5}$ mm Hg. to control the amount of species under test in the chamber. A gated electron beam [where is it in FIG. 1 and how strong should be beam be? Give range and preferred value.] is then sent along the length of the chamber and along the axis of the tube to create a cylinder-shaped collection of low energy ions of the species under test within the tube. The electron beam is then gated off.

The ions are then excited by applying a sweep pulse across the excite electrodes in the tube which sweeps out a frequency frequency range that covers the resonant frequency or frequencies of all species under test, this range generally being from about 200 KHz to about 2 MHz. As the pulse sweeps through the frequency range which represents the fundamental cyclotron frequencies of all ions of interest, this energy is absorbed by the ions, causing the ions to spin up to larger orbitals in order to move the ions closer to the detect electrodes. The excited ions are detected by the detect electrodes by monitoring the current induced onto the detect electrodes by the ions. The magnitude of current induced onto the detect electrodes is directly proportional to the number of ions present in the tube which should also be proportional to the number of ions present in the chamber. This current appears as a sine wave. By sending the signal from each of the two detect electrodes to each side of a difference amplifier, the result is a sine wave signal or a superposition of plural sine wave signals when plural species are present in the chamber. The sine wave is easily converted into a frequency value by subjecting it to a Fourier transform which yields a frequency spectrum, this frequency spectrum being converted to a mass spectrum, given that the amount of energy used to excite the ions to their higher-energy cyclotron orbit is known and the velocity of each ion is known based upon its cyclotron frequency (the measured parameter). If the species under test includes more than one type of ion (i.e., the term "species" is plural), then there is a superposition of several sine waves, requiring that a Fourier transform be performed thereon to obtain an indication of each of the distinct frequencies present. The Fourier transform is not required for a single waveform. The atomic weight of each species can thereby be provided with accuracy from about 6 to about 10 decimal places. The above described procedure can be repeated many times per second to permit signal averaging and averaging out of noise, thereby providing improved signal/noise ratios.

DESCRIPTION OF THE PREFERRED EMBODIMENT

Figure 1:
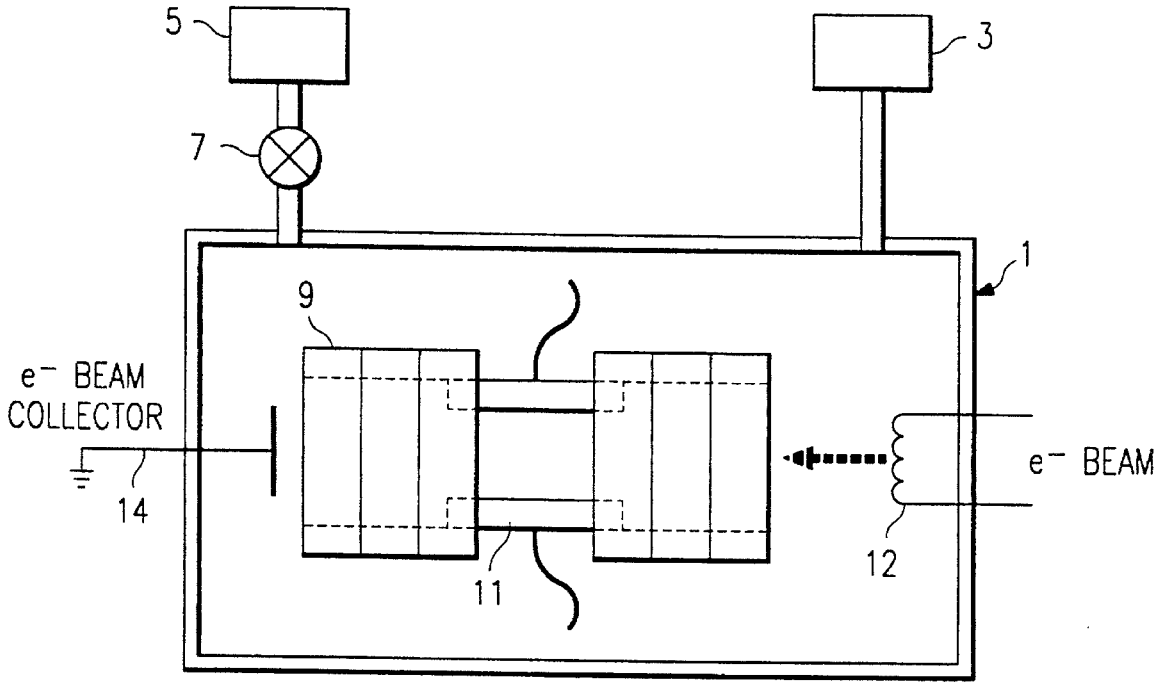
FIG. 1 is a schematic diagram of a FTICR/MS in accordance with the present invention.
Figure 2:
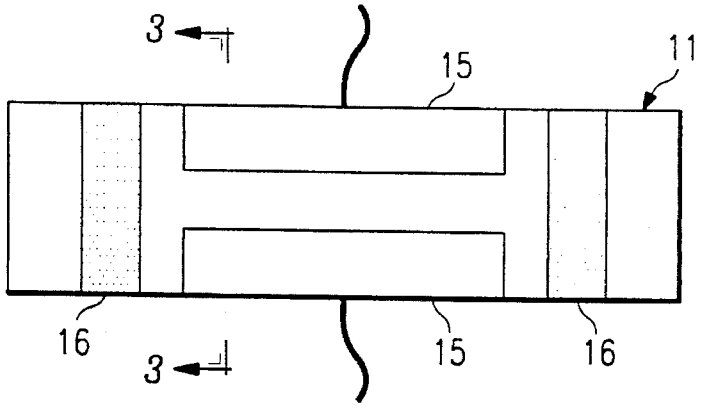
FIG. 2 is a side view of the tube 11 of FIG. 1.
Figure 3:
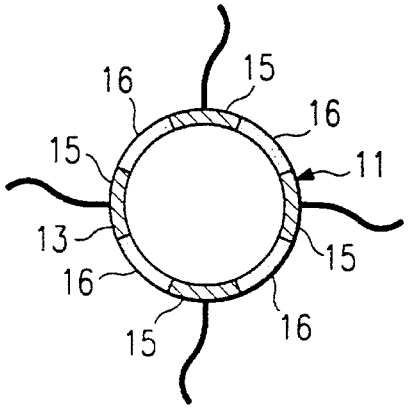
FIG. 3 is a cross-sectional view taken along the line 2—2 of FIG. 2.

Referring to FIGS. 1 to 3, there is shown a schematic drawing of a FTICR/MS in accordance with the present invention. The FTICR/MS includes a chamber 1 of stainless steel to which is connected a pump 3 for evacuating the chamber and controlling the concentration of molecules within the chamber. A source of the species under test 5 applies the species to the chamber 1 through a valve 7. Disposed within the chamber are magnets 9 disposed over a ceramic, preferably glass, tube 11.

The magnets 9 each have a central bore and are provided in two groups with a separation between the two groups. Three magnets 9 are shown in each group, however this number is arbitrary and is determined by the strength of the magnetic field required in each case and the magnetic field provided by each magnet. It is merely necessary that the magnetic field be sufficiently strong to accommodate the species under test. The larger the atomic weight of the species under test, the larger will be the strength of the magnetic field required. It is also desirable that the magnets be separated at the central region thereof. This provides an improved magnetic field and permits easy access to the tube 11 disposed in the bore of the magnets as will be discussed hereinbelow. Preferred magnets have been a cobalt rare earth magnet having a magnetic field strength of about 0.8 Tesla (8000 Gauss) and a neodymium boron rare earth magnet having a magnetic field strength of about 0.92 Tesla (9200 Gauss). The magnetic field provided along the bore of the magnets 9 serves to both constrain the radial motion of the ions as well as to establish their cyclotron motion.

The tube 11 has two pairs of opposing electrodes disposed on the interior surface thereof as shown in FIG. 3, one pair of opposing electrodes 13 being the excite electrodes and the other pair of opposing electrodes 15 being the detect electrodes. The excite electrodes are disposed in one pair of opposing quadrants of the tube 11 and the detect electrodes are disposed in the other pair of opposing quadrants of the tube. A wire extends through the glass tube 11 to each of the excite electrodes 13 and to each of the detect electrodes 15. The electron beam is provided by a filament 12 located axially at one end of tube 11 and a collector electrode 14 at the opposing end of tube 11. A pair of trap electrodes 16 are disposed on both sides of the excite electrodes 13 and detect electrodes 15 on the interior surface of tube 11 in the form of a ring of the same electrically conductive material as the excite and detect electrodes.

In operation, the chamber 1 is evacuated to a pressure below $5\times10_{-5}$ mm Hg with the pulsed valve 7 closed and the pump 3 operating to provide the vacuum and the chamber is quenched by dropping the potential of one of the trap electrodes to −5 volts while raising the other trap electrode to +5 volts. The trap electrodes are then returned to their normal setting of about +2 volts. The valve 7 is then opened to permit the neutral species under test to enter from source 5 into the chamber 1 at a predetermined rate with the vacuum being maintained at 0.05 mm Hg. by the pump 3 to control the amount of species under test in the chamber 1. A gated 70 eV electron beam is then sent along the length of the chamber and along the axis of the tube 11 to create a cylinder-shaped collection of low energy ions of the species under test. The electron beam is then gated off.

The ions are then excited by applying a sweep pulse which sweeps from a frequency of about 200 KHz to about 2 MHz across the excite electrodes 13. As the pulse sweeps through the frequency range which represents the fundamental cyclotron frequencies of all ions of interest, this energy is absorbed by the ions, causing the ions to spin up to larger orbitals in order to move the ions closer to the detect electrodes 15.

The excited ions are detected by the detect electrodes by monitoring the current induced onto the detect electrodes by the excited ions. The magnitude of current induced onto the detect electrodes 15 is directly proportional to the number of ions present in the tube 11 which should also be proportional to the number of ions present in the chamber 1. This current appears as a sine wave. By sending the signal from each of the two detect electrodes 15 to each side of a difference amplifier, the result is a sine wave signal or a superposition of plural sine wave signals when plural species are present in the chamber 1. The sine wave is easily converted into a frequency value by subjecting it to a Fourier transform which yields a frequency spectrum when plural frequencies are present in standard manner, this frequency spectrum being converted to a mass spectrum, given that the amount of energy used to excite the ions to their higher-energy cyclotron orbit is known and the velocity of each ion is known based upon its cyclotron frequency (the measured parameter). If the species under test includes more than one type of ion (i.e., the term "species" is plural), then there is a superposition of several sine waves, requiring that a Fourier transform be performed thereon to obtain an indication of each of the distinct frequencies present. The above described procedure can be repeated many times per second to permit signal averaging and averaging out of noise, thereby providing improved signal/noise ratios.

Though the invention has been described with respect to a specific preferred embodiment thereof, many variations and modifications will immediately become apparent to those skilled in the art. It is therefore the intention that the appended claims be interpreted as broadly as possible in view of the prior art to include all such variations and modifications.

We claim:

1. A mass spectrometer which comprises:

(a) a tube permeable to a magnetic flux and having an exterior surface and an interior surface, said tube having a pair of opposing excite electrodes, a pair of opposing detect electrodes and a pair of trap electrodes on opposing sides of said excite electrodes and said detect electrodes, said electrodes disposed on one of said exterior or interior surface;

(b) a pair of spaced apart magnets disposed on said exterior surface of said tube, said excite electrodes and said detect electrodes being disposed at least in part between said pair of magnets;

(c) an evacuatable chamber containing said tube and said magnets; and (d) means to evacuate said evacuatable chamber.

2. The mass spectrometer of claim 1 wherein all of said electrodes are disposed on said interior surface of said tube.

3. The mass spectrometer of claim 1 wherein said tube is one of a glass tube or a quartz tube.

4. The mass spectrometer of claim 1 wherein said excite electrodes are disposed in a first pair of opposing quadrants and said detect electrodes are disposed in a second pair of opposing quadrants.

5. The mass spectrometer of claim 2 wherein said excite electrodes are disposed in a first pair of opposing quadrants and said detect electrodes are disposed in a second pair of opposing quadrants.

6. The mass spectrometer of claim 3 wherein said excite electrodes are disposed in a first pair of opposing quadrants and said detect electrodes are disposed in a second pair of opposing quadrants.

7. The mass spectrometer of claim 1 wherein said excite electrodes are substantially parallel to each other and said detect electrodes are substantially parallel to each other and substantially normal to said excite electrodes.

8. The mass spectrometer of claim 5 wherein said excite electrodes are substantially parallel to each other and said detect electrodes are substantially parallel to each other and substantially normal to said excite electrodes.

9. The mass spectrometer of claim 1 wherein said magnets are rare earth magnets.

10. The mass spectrometer of claim 8 wherein said magnets are rare earth magnets.

11. The mass spectrometer of claim 1 wherein said magnets are taken from the class consisting of cobalt rare earth magnets and neodymium cobalt rare earth magnets.

12. The mass spectrometer of claim 8 wherein said magnets are taken from the class consisting of cobalt rare earth magnets and neodymium cobalt rare earth magnets.

13. The mass spectrometer of claim 1 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

14. The mass spectrometer of claim 2 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

15. The mass spectrometer of claim 3 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

16. The mass spectrometer of claim 4 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

17. The mass spectrometer of claim 5 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

18. The mass spectrometer of claim 6 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

19. The mass spectrometer of claim 7 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

20. The mass spectrometer of claim 8 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

21. The mass spectrometer of claim 9 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

22. The mass spectrometer of claim 10 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

23. The mass spectrometer of claim 11 further including plural conductors, one conductor for each of said excite electrodes and said detect electrodes, each said conductor extending through said tube to a different one of said excite electrodes and said detect electrodes, for applying a sweep signal to said excite plaelectrodes and detecting one of a voltage or current across said detect electrodes.

24. The mass spectrometer of claim 12 further including plural conductors, one conductor for each of said excite electrodes and said detect electrodes, each said conductor extending through said tube to a different one of said excite electrodes and said detect electrodes, for applying a sweep signal to said excite electrodes and detecting one of a voltage or current across said detect electrodes.

* * * * *